US006792900B2

(12) United States Patent
Kato

(10) Patent No.: US 6,792,900 B2
(45) Date of Patent: Sep. 21, 2004

(54) LUBRICATION SYSTEM FOR TWO-CYCLE ENGINE

(75) Inventor: Masahiko Kato, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/255,662

(22) Filed: Sep. 26, 2002

(65) Prior Publication Data

US 2003/0062007 A1 Apr. 3, 2003

(30) Foreign Application Priority Data

Sep. 28, 2001 (JP) ..... 2001-301620

(51) Int. Cl.[7] ..... F02B 33/04
(52) U.S. Cl. ..... 123/73 AD; 184/15
(58) Field of Search ..... 123/73 AD, 196 R; 184/1, 5, 14

(56) References Cited

U.S. PATENT DOCUMENTS 5,617,822 A * 4/1997 Masuda ..... 123/196 R
5,806,631 A * 9/1998 Yoshida et al. ..... 184/18
5,887,678 A * 3/1999 Lavender ..... 184/11.2

* cited by examiner

*Primary Examiner*—Tony M. Argenbright
*Assistant Examiner*—Katrina B. Harris
(74) *Attorney, Agent, or Firm*—Knobbe, Martens, Olson & Bear LLP

(57) ABSTRACT

A lubrication system for two-cycle engine includes a lubricant recess formed in a wall of a crankcase. Oil that becomes deposited within the intake passageway is directed to the lubricant recess preferably by a guide groove and pools adjacently below a connecting rod endcap. As the crankshaft with attached connecting rod rotates, pooled oil is drawn into the interior of the connecting rod endcap. Preferably, oil holes are formed radially outward through the connecting rod endcap to throw collected oil around the crankcase chamber when exposed to a centrifugal force.

20 Claims, 8 Drawing Sheets

LUBRICATION SYSTEM FOR TWO-CYCLE ENGINE

PRIORITY INFORMATION

This application is based on and claims priority to Japanese Patent Application No. 2001-301620, filed Sep. 28, 2001 the entire contents of which is hereby expressly incorporated by reference.

BACKGROUND OF THE INVENTION

1. Field of the Invention

The present invention relates to oil injection lubrication for engines and more particularly to oil injection systems and methods for lubricating a two-cycle engine.

2. Description of the Related Art

In two-cycle engines, it is a common practice to mix lubricating oil with induction air to lubricate engine parts. Typically, the intake air is pre-compressed inside a crank chamber before being sent into the cylinders. In this type of two-cycle engine, oil is guided to an intake passage and further into the engine by the intake air. More specifically, the oil encounters the intake air inside the intake passage and is misted therein. The misted oil is then drawn into the crank chamber as the piston ascends and a valve opens to allow intake air to enter the crank chamber. The misted oil lubricates rotating parts in and around the crankshaft and within the interior wall of the cylinder.

In conventional two-cycle engines, fuel mixes with the intake air inside the intake passageway to reduce the viscosity of the oil which promotes misting of the oil. However, in direct injection-type two-cycle engines in which the fuel is directly sprayed into the combustion chamber, the viscosity of the oil drawn into the crank chamber is not reduced by dilution with the fuel. The undiluted liquid oil is, therefore, more difficult to convert into a mist. Since the oil may not be sufficiently misted in the intake air, the amount of oil supplied to the engine may be reduced. Insufficiently misted oil results in liquid oil depositing onto the interior wall surface inside the intake passageway. More liquid oil deposits on the wall surfaces of the intake passageway when the flow of intake air decreases, such as during low speed operation.

SUMMARY OF THE INVENTION

One aspect of the present invention includes the realization that the rotation of the crankshaft of an internal combustion engine can be used to redistribute oil that has condensed in the crankcase chamber. For example, a lubricant recess can be preferably located adjacent, and generally below, a throw of a vertically-oriented crankshaft, such that a connecting rod endcap attached to the crankshaft throw passes over the recess during at least a portion of its rotational travel. The endcap is preferably configured with radial oil holes to help establish a flow path caused by a pressure differential due to rotation of the crankshaft. In at least one embodiment, the pressure differential is sufficient to draw oil from the recess into the endcap and throw the oil about the crankcase chamber.

According to another aspect of the present invention, a lubrication system for a two-cycle engine is provided. The engine, which may be of the direct fuel injection type, has a vertical crankshaft and a lubrication recess disposed generally adjacent to a throw of the crankshaft. The lubrication recess opens upwardly such that at least a portion of a connecting rod endcap passes over the recess.

The lubrication recess is preferably formed in an interior wall of the engine crankcase. Liquid oil may be directed to the lubrication recess by a guide groove that extends from an air intake of the crankcase to the lubrication recess.

The endcap preferably has one or more holes formed therethrough and providing an opening in an interior surface of the endcap and an opening in the exterior surface of the endcap. As the crankshaft rotates, the opening in the interior surface of the endcap preferably passes over the lubrication recess during a predetermined range of crankshaft rotation.

According to another aspect, a two-stroke engine has one or more cylinders with each cylinder having a piston, a vertical crankshaft, and a connecting rod that connects the piston to a throw of the crankshaft. The connecting rod has an endcap that allows it to connect to the crankshaft throw, the endcap having one or more oil holes formed therethrough thus providing fluid communication between an opening in an interior peripheral surface and an opening in an exterior peripheral surface of the endcap. A lubrication recess is formed adjacent the crankshaft and generally below a crankshaft throw. As the crankshaft rotates, each opening in the interior peripheral surface of the endcap to pass over the lubrication recess.

The crankshaft rotation can cause a pressure differential between the interior and exterior surfaces of the endcap sufficient to draw oil from within the lubrication recess upwardly and into the interior peripheral surface opening. The oil is then thrown through the exterior peripheral surface opening.

Another aspect of the present invention is directed to an outboard motor having a powerhead, a driveshaft housing depending from the powerhead, and a lower unit connect to and disposed below the driveshaft housing. The powerhead includes an internal combustion engine coupled to a propeller of the lower unit through a driveshaft extending through the driveshaft housing for propelling a watercraft. The internal combustion engine further has a cylinder block defining a cylinder bore and a cylinder head connected to the cylinder block. The cylinder head has a recess in one of its surfaces which cooperates with a piston surface and the cylinder bore to define a combustion chamber.

A vertical crankshaft is configured for rotation within a crankcase chamber formed, in part, by a crankcase member, and is coupled to the piston through a connecting rod that has a large end engaging the crankshaft and a small end engaging the piston. The crankcase member further defines an air intake passageway having an air and oil regulating valve disposed therein.

A lubrication recess is formed by the crankcase member and is disposed generally below the large end of the connecting rod during at least a range of the crankshaft rotation. The crankcase member further defines a guide groove configured to urge deposited lubricant to flow toward the lubricant recess.

The large end of the connecting rod draws lubricant from the lubricant recess and throws the lubricant within the crankcase chamber.

According to yet another aspect, a two-stroke internal combustion engine includes one or more cylinders and a piston for reciprocating within each cylinder. A connecting rod is rotatably coupled to each piston and is further coupled to a throw of a vertical crankshaft by an endcap. The crankshaft and connecting rod are disposed within a crankcase chamber.

One or more oil holes are formed radially through the endcap thereby providing fluid communication between a first opening disposed inwardly from an outer peripheral surface and a second opening in the outer peripheral surface of the endcap.

A lubrication recess can be disposed adjacent the crankshaft and generally below a throw of the crankshaft during at least a range of its rotation. Rotation of the crankshaft may cause lubricant from within the lubrication recess to be drawn into the first opening and discharged out of the second opening. Rotation of the crankshaft can cause a pressure differential sufficient to draw lubricant into the first opening. The lubricant can further be used to lubricate the coupling between the connecting rod and the throw of the crankshaft.

The crankshaft rotation can additionally or alternatively cause the endcap to splash the lubricant within the lubrication recess thereby forcing lubricant into the first opening.

A guide groove may be provided in a lower surface of the crankcase and extend generally from an air intake of the crankcase to the lubrication recess.

According to another aspect, a two-stroke internal combustion engine has one or more cylinder each having a piston for reciprocation therein. Each piston is rotatably coupled to a connecting rod which is, in turn, coupled to a throw of a crankshaft by an endcap. The crankshaft is disposed generally vertically within a crankcase chamber of the engine. A lubrication recess is disposed adjacent to the crankshaft and generally below a throw of the crankshaft.

Liquid oil within the crankcase chamber may collect within the lubrication recess, after which the endcap and/or connecting rod can throw the collected oil about the crankcase chamber.

According to yet another aspect, an outboard motor has an internal combustion engine with a crankshaft journaled for rotation within a crankcase and couple to a driveshaft for rotating a propeller connect to the driveshaft. The internal combustion engine includes means for causing oil to pool adjacent a throw of the crankshaft and means for redistributing pooled oil around the crankcase.

DETAILED DESCRIPTION OF THE PREFERRED EMBODIMENT

In the following description, reference is made to the accompanying drawings which form a part of this written description which show, by way of illustration, specific embodiments in which the invention can be practiced. It is to be understood that other embodiments may be utilized and structural changes may be made without departing from the scope of the present invention. Where possible, the same reference numbers will be used throughout the drawings to refer to the same or like components. Numerous specific details are set forth in order to provide a thorough understanding of the present invention; however, it would be obvious to one skilled in the art that the present invention may be practiced without the specific details or with certain alternative equivalent devices and methods to those described herein. In other instances, well-known methods, procedures, components and devices have not been described in detail so as not to unnecessarily obscure aspects of the present invention.

Figure 1:
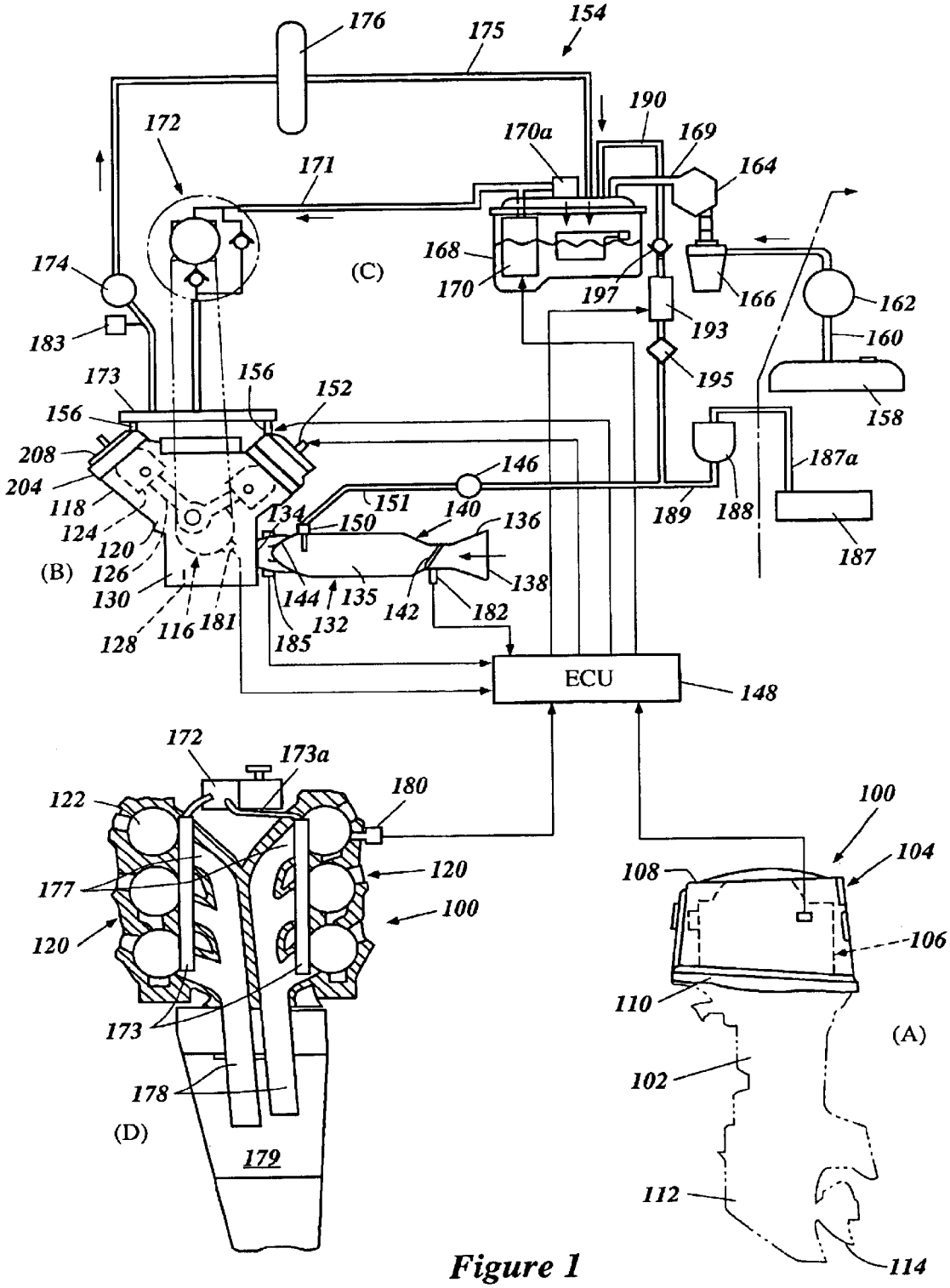
FIG. 1 is a schematic diagram illustrating the fuel and oil supply system of an engine in which one embodiment of the lubrication system of the present invention is invented.

With reference to FIG. 1, and initially Section A, an outboard motor constructed and operated in accordance with a preferred embodiment of the invention is depicted in a side elevational view and is identified generally by the reference numeral 100. The entire outboard motor 100 is not depicted in that the swivel bracket and the clamping bracket which are associated with the driveshaft housing indicated generally by the reference numeral 102 are not illustrated. These components are well known in the are and thus the specific method by which the outboard motor 100 is mounted to the transom of an associated watercraft is not necessary to permit those skilled in the art to understand or practice the invention.

The outboard motor 100 includes a powerhead indicated generally by the reference numeral 104. The powerhead 104 is positioned above the driveshaft housing 102 and includes a powering internal combustion engine indicated generally by the reference numeral 106. The engine 106 is shown is more detail in the remaining three views of FIG. 1 and is described below with reference thereto.

The powerhead 104 is completed by a protective cowling formed by a main cowling member 108 and a lower tray 110. The main cowling member 108 is detachably connected to the lower tray 110. The lower tray 110 encircles an upper portion of the driveshaft housing 102 and a lower end of the engine 106.

Positioned beneath the driveshaft housing 102 and coupled thereto is a lower unit 112 in which a propeller 114 which forms the propulsion device for the associated watercraft is journaled. As is typical with outboard motor practice, the engine 106 is supported in the powerhead 104 so that its crankshaft 116 (see Section B of FIG. 1) rotates about a vertically extending axis. This facilitates connection of the crankshaft 116 to a driveshaft which extends into the lower unit 112 and which drives the propeller 114 through a conventional forward-neutral-reverse transmission contained in the lower unit 112.

The details of the construction of the outboard motor 100 and the components which are not illustrated may be considered to be conventional or of any type known to those wishing to utilize the invention disclosed herein. Those skilled in the art can readily refer to any known constructions of such with which to practice the invention.

With reference now in detail to the construction of the engine 106 still by primary reference to FIG. 1, the illustrated embodiment of the engine 106 is of the V6-type and operates on a two-stroke crankcase compression principal. Although the invention is described in conjunction with an engine having a particular cylinder number and cylinder configuration, it will be readily apparent that the invention can be utilized with engines having other cylinder numbers and other cylinder configurations. Also, although the engine 106 is described as operating on a two-stroke principal, it will also be apparent to those skilled in the art that certain facets of the invention can be employed in conjunction with four-stroke engines. Some features of the invention may also be employed with rotary-type engines.

With reference primarily to Sections B and D of FIG. 1, the engine 106 comprises a cylinder block 118 that is formed with a pair of cylinder banks 120. Each of the cylinder banks 120 comprises three vertically spaced, horizontally extending cylinder bores 122. The cylinder bores 122 are numbered #1–6 from top to bottom and will be referred to individually as cylinder 1, cylinder 2, etc. Pistons 124 reciprocate in the cylinder bores 122. The pistons 124 are in turn connected to the upper or small ends of connecting rods 126. The big ends of these connecting rods are journaled on the throws of the crankshaft 116 in a manner that is well-known in the art.

The crankshaft 116 is journaled in a suitable manner for rotation within a crankcase chamber 128 that is formed by part of the cylinder block 118 and by the crankcase member 130. The crankcase member 130 is affixed to the cylinder block 118 in a suitable manner. As is typical with two-cycle engines, the crankshaft 116, cylinder block 130, and crankcase member 130 are formed with seals so that each section of the crankcase 128 which is associated with one of the cylinder bores 122, is sealed from the other sections. This type of construction is well-known in the art.

Figure 2:
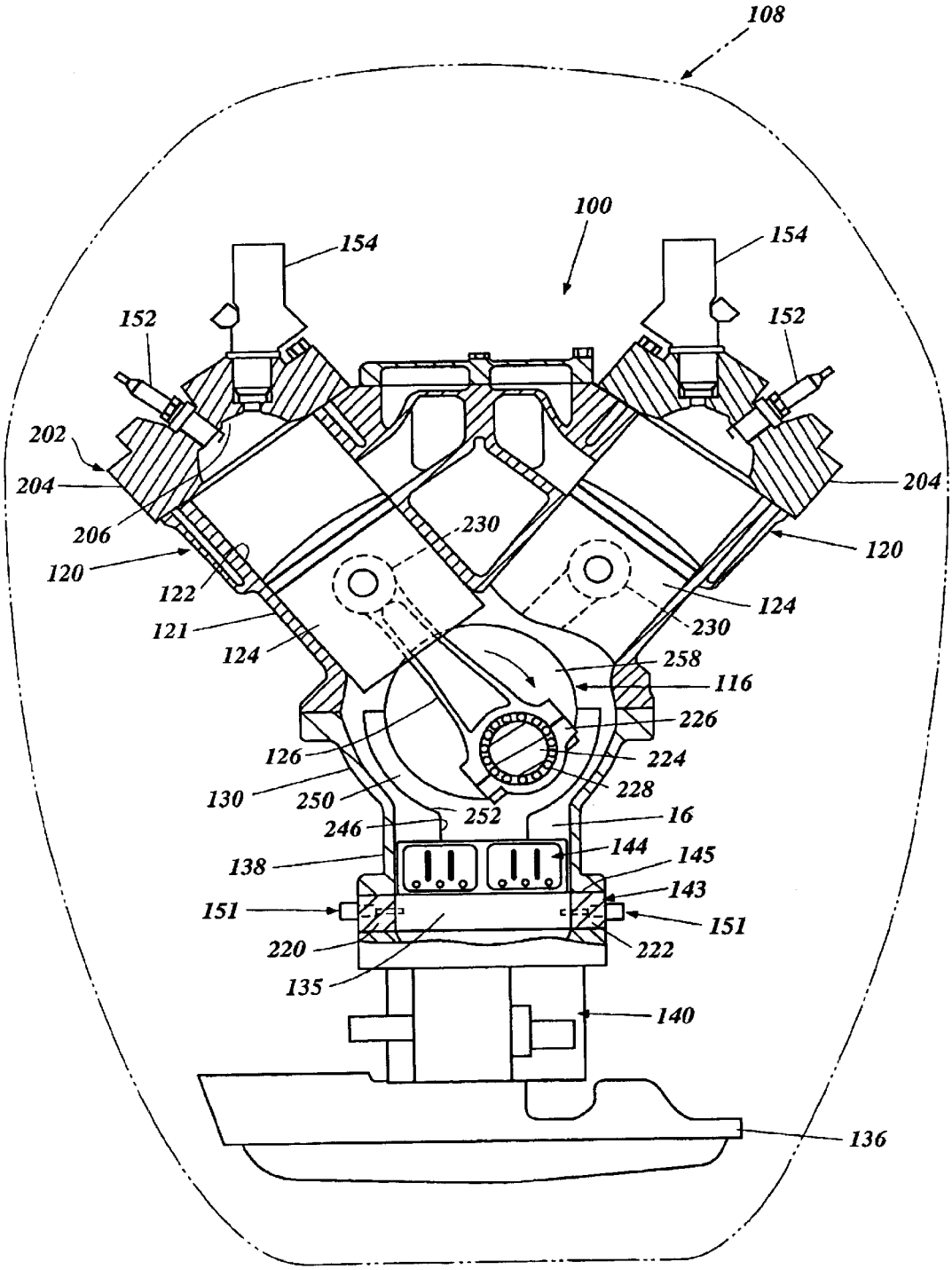
FIG. 2 is a partial top plan and a cross-sectional view of the outboard motor illustrated in FIG. 1, showing a crankshaft and piston rod assembly with in a case of the engine.

With additional reference to FIG. 2, a cylinder head assembly, indicated generally by the reference numeral 202, is affixed to an end of each cylinder bank 120 that is spaced from the crankcase chamber 128. The cylinder head assemblies 202 comprise a main cylinder head member 204 that defines a plurality of recesses 206 on its inner face. Each of these recesses 206 cooperate with a respective cylinder bore 122 and the head of the piston 124 to define the combustion chambers of the engine as is well known in the art. A cylinder head cover member 208 completes the cylinder head assembly 202. The cylinder head members 204, 208 are affixed to each other and to the respective cylinder banks 120 in a suitable known manner.

With reference again primarily to FIG. 1, Sections B and C, an air induction system indicated generally by the reference numeral 132 is provided for delivery of an air charge to the sections of the crankcase chamber 128 associated with each of the cylinder bores 122. This communication is via an intake port 134 formed in the crankcase member 130 and registering with each such crankcase chamber section.

The induction system 132 includes an air silencing and inlet device shown schematically in this FIG. 1 and indicated by the reference numeral 136. The device 136 is typically contained within the cowling 108 at the forward end thereof and has a rearwardly facing air inlet opening 138 through which air is drawn. Air is admitted into the interior of the cowling 108 in a known manner such as primarily through a pair of rearwardly positioned air inlets as is generally well-known in the art.

The air inlet device 136 supplies the induced air through a plurality of throttle bodies 140, each of which includes a throttle valve 142 positioned therein. The throttles valves 142 are supported for rotation on throttle valve shafts (not shown). The throttle valve shafts are linked to each other for simultaneous opening and closing of the throttle valves 142 in a manner well-known in the art.

As is also typical in two-cycle engine practice, the intake ports 134 are provided with reed-type check valves 144. The check valves 144 permit air to flow into the sections of the crankcase chamber 128 when the pistons 124 are moving toward the recesses 206 in their respective cylinder bores 122. As the pistons 124 move toward the crankcase 128, the charge is compressed in the sections of the crankcase chamber 128. At that time, the reed-type check valve 144 closes so as to permit the charge to be compressed.

In accordance with at least one preferred embodiment of the present invention, an oil pump 146 pumps oil to a solenoid valve unit 150 through an oil delivery hose 151. In one preferred embodiment, the oil pump 146 is driven by the crankshaft 116; however, an electric oil pump may be used in the alternative. The solenoid valve unit 150 may regulate the delivery of oil to the throttle body 140 of each cylinder 122, in which case, the oil passes through the throttle body 140 and into the crankcase chamber 128 to lubricate the components of each cylinder 122. The air charge, which is compressed in the sections of the crankcase chamber 128, is then transferred to the combustion chamber through a scavenging system (not shown) in a manner that is well known.

A sparkplug 152 is mounted in the cylinder head assembly 202 for each cylinder bore. The sparkplug 152 is fired under control of an ECU 148 (electronic control unit). The ECU 148 receives certain signals for controlling the timing of firing of the sparkplugs 152 in accordance with any desired control strategy.

The sparkplug 152 ignites a fuel-air charge that is formed by mixing the intake air with fuel supplied from a fuel delivery system 154. With reference to Section C and D of FIG. 1, the fuel supply system 154 is configured to supply fuel to the combustion chambers through fuel injectors 156. In the illustrated embodiment, the fuel system 154 comprises a main fuel supply tank 158 that is provided in the hull of the watercraft with which the outboard motor 100 is associated. Fuel is drawn from this tank 158 through a conduit 160 by a first low pressure pump 162 and a plurality of second low pressure pumps 164. The first low pressure pump 162 is a manually operated pump and the second low pressure pumps 164 are diaphragm-type pumps operated by variations in pressure in the sections of the crankcase chamber 128 and thus provide a relatively low pressure. A quick disconnect coupling is provided in the conduit 160 and a fuel filter 166 is positioned in the conduit 160 in an appropriate location.

From the low pressure pump 164 fuel is supplied through a vapor separator 168 which is mounted on the engine 106 or within the cowling 108 at an appropriate location. This fuel is supplied through a line 169 and a float valve regulates fuel flow through the line 169. The float valve is operated by a float that is disposed within the vapor separator 168 so as to maintain a generally constant level of fuel in the vapor separator 168.

A high pressure electric fuel pump 170 is provided in the vapor separator 168 and pressurizes fuel that is delivered through a fuel supply line 171 to a high pressure fuel pump indicated generally by the reference numeral 172. The electric fuel pump 170 which is driven by an electric motor develops a pressure such as within the range of from about 3 to about 10 kg/cm$^2$. A low pressure regulator 170A is positioned in the line 171 at the vapor separator 168 and limits the pressure that is delivered to the high pressure fuel pump 172 by dumping the fuel back to the vapor separator 168.

With reference to Section D of FIG. 1, fuel is supplied from the high pressure fuel pump 172 to a pair of vertically extending fuel rails 173 through a flexible pipe 173A. The pressure in the high pressure pump 172 is regulated by a high pressure regulator 174 which dumps fuel back to the vapor separator 168 through a pressure relief line 175 in which a fuel heat exchanger or cooler 176 may be provided.

After the fuel charge has been formed in the combustion chamber by the injection of fuel from the fuel injectors 156, the charge is fired by firing sparkplugs 152. The injection timing and duration, as well as the control for the timing of firing of the sparkplugs 152 are controlled by the ECU 148.

As the charge burns and expands, the pistons 124 are driven toward the crankcase chamber 128 in the cylinder bores 122 until the pistons 124 reach the lower most position (i.e., bottom dead center). Through this movement, an exhaust port (not shown) is opened to communicate with an exhaust passage 177 formed in the cylinder block 118. The exhaust gases flow through the exhaust passages 177 to collector sections of respective exhaust manifolds that are formed within the cylinder block 118. These exhaust manifold collector sections communicate with exhaust passages formed in an exhaust guide plate on which the engine 106 is mounted.

The ECU 148 controls the timing and duration of fuel injection. The ECU 148 thus controls the opening and closing of the solenoid valves of the fuel injectors 156 and in particular controls the selective supply of current to the solenoids of the fuel injectors 156.

A pair of exhaust pipes 178 extend the exhaust passages 177 into an expansion chamber 179 formed in the driveshaft housing 102. From this expansion chamber 179, the exhaust gases are discharged to the atmosphere through a suitable exhaust system. The length of the exhaust pipes 178 from the cylinder 122 to the head of the exhaust pipe 178 differs between some or all of the cylinders 122. As is well-known in outboard motor practice, this may include an underwater, high-speed, exhaust gas discharge and an above-water low speed exhaust gas discharge. Since these types of systems are well-known in the art, further description is not necessary to permit those skilled in the art to practice the invention.

Any type of desired controlled strategy can be employed for controlling the time and duration of fuel injection from the injectors 154 and timing of firing of the sparkplug 152. However, a general discussion of some engine conditions and other ambient conditions that can be sensed for engine control will follow. It is to be understood, however, that those skilled in the art will readily understand how various control strategies can be employed in conjunction with the components of the invention.

The control for the fuel air ratio preferably includes a feedback control system. Thus, a combustion condition or oxygen sensor 180 is provided and determines the in-cylinder combustion conditions by sensing the residual amount of oxygen in the combustion products at about a time when the exhaust port is opened. This output signal is carried by a line to the ECU 148 as schematically illustrated in FIG. 1.

As shown in Section B of FIG. 1, a crank angle position sensor 181 measures the crank angle and transmits it to the ECU 148 as schematically indicated. Engine load as determined by throttle angle of the throttle valve 142 is sensed by a throttle position sensor 182 which outputs a throttle position or load signal to the ECU 148.

There is also provided a pressure sensor 183 communicating with the fuel line connected to the pressure regulator 174. This pressure sensor 183 outputs the high-pressure fuel signal to the ECU 148. Further, an intake air temperature sensor 185 may be provided when this sensor 185 outputs an intake air temperature signal to the ECU 148.

The sense conditions are merely some of those conditions which may be sensed for engine control and it is, of course, practicable to provide other sensors such as, for example, but without limitation, an engine height sensor, a knock sensor, a neutral sensor, a watercraft pitch sensor and an atmospheric temperature sensor in accordance with various control strategies.

The ECU 148 computes and processes the detection signals of each sensor based on a control strategy. The ECU 148 forwards control signals to the fuel injector 156, sparkplug 152, the electromagnetic solenoid valve unit 150 and the high-pressure electric fuel pump 170 for their respective control. These control signals are carried by respective control lines that are indicated schematically in FIG. 1.

With reference to Section C of FIG. 1, an oil subtank 187 located in the hull of the watercraft serves as a reservoir of lubrication oil for the engine 106. A suitable delivery pump supplies oil from the oil subtank 187 through the oil supply pipe 187A to a main oil tank 188 mounted to the side of the cylinder block 118. The delivery pump can, for example, be located within the oil subtank 187 or can be positioned within the supply pipe 187A and can be either electrically or mechanically driven. An oil feedpipe 189 supplies oil from the bottom of the main oil tank 188 to the oil pump 146. The oil pump 146 in turn supplies oil to the solenoid valve unit 150 which regulates the flow of oil to the cylinders. The solenoid valve unit 150 is preferably controlled via control signals from the ECU 148.

In one preferred embodiment, oil is also delivered directly to the vapor separator chamber 168. A premixing oil pump 193 draws oil from the oil feedpipe 189 and through a premixing oil filter 195. The oil also passes through a reed-type check valve 197 and is then delivered to the vapor separator chamber 168 through oil conduit 190. The addition of a small amount of oil to the fuel of a fuel-injected engine has been found to inhibit the formation of deposits on fuel injectors 154 and to extend their useful life. The addition of oil may also help prevent corrosion when water is present in the system. The oil delivered directly to the combustion chamber with the fuel charge can also help to lubricate the components of the fuel system.

In at least one embodiment, a plurality of oil conduits 151 are provided for delivering oil to a plurality of solenoid valve units 150 which correspond to the number of cylinders 122 in the engine 106. The oil supply pipes 151 are preferably configured so that their lengths are as short as possible to minimize the distance the oil must travel to the air induction system 132 for each cylinder 122.

In one preferred embodiment, the oil pump 146 is a positive displacement-type oil pump that is driven by the crankshaft 116. A positive displacement type oil pump delivers a volume of oil for each crankshaft revolution as opposed to, for example, an impeller-type pump that supplies an approximate pressure of oil based upon engine speed.

The oil delivered through the oil supply pipe 151 is regulated by the solenoid valve unit 150 for delivery into the air intake passage 135. Preferably, the oil is sprayed into the air intake passage 135 as a mist, such that the oil is carried by the intake air passing through the air intake passage 135. The air thus carries misted oil into the crankcase chamber 128 and subsequently into the combustion chamber 206.

Figure 3:
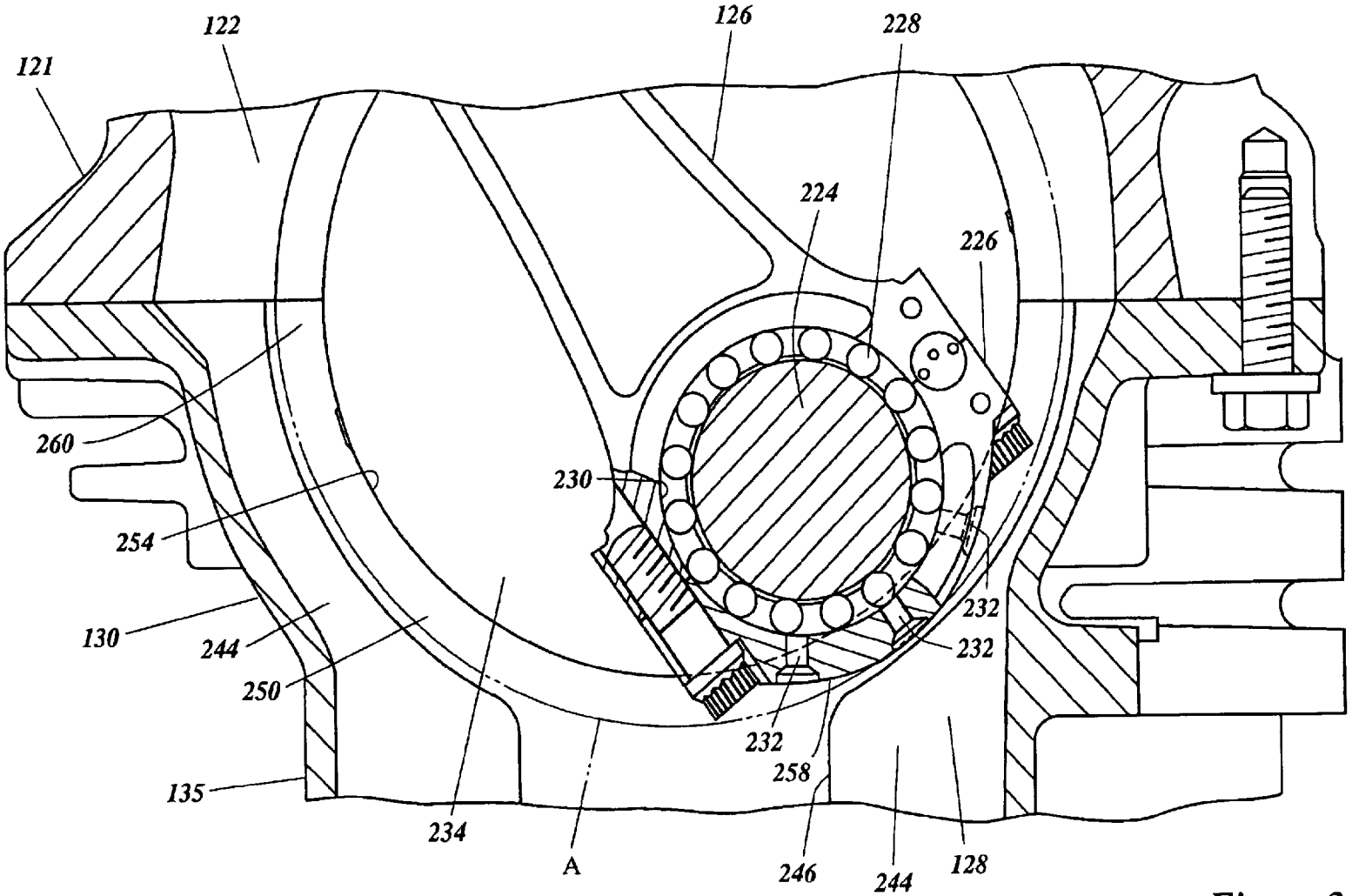
FIG. 3 is an enlarged cross-sectional view of the crankshaft and piston rod assembly of FIG. 2.

With reference to FIGS. 2 and 3, the intake silencer 136 includes an opening for allowing intake air to enter therein.

The air flows through the intake silencer 136 and is regulated by throttle valves 142 within the throttle body 140. The air intake passageway 135 is partially defined by a left side part 220 and a right side part 222 that each hold one or more oil delivery pipes 151. The oil delivery pipes 151 regulate the delivery of oil into the intake air as previously described.

A reed-valve unit 143 comprises a reed valve holder 145 which carries a number of reed valves 144, which typically correspond in number to the number of engine cylinders. The intake air is drawn through the reed valves 144 and into the crankcase chamber 128 as the piston 124 reciprocates upwardly thereby causing a negative pressure within the crankcase chamber 128.

The crankshaft 116 is journaled for rotation within the crankcase chamber 118 and has a number of throws 224 each of which are connected to a connecting rod 126. The connecting rod 126 typically terminates in a semi-circular concave inner peripheral surface that corresponds to a portion of the crankshaft throw 224. An endcap 226 cooperates with the connecting rod 126 to circumscribe the crankshaft throw 224.

A plurality of roller bearings 228 are interposed between the interior peripheral surface 230 of the connecting rod 126 and the crankshaft 116. Alternatively, the connecting rod 126 may engage the crankshaft throw 225 through other means, as are known in the art. The connecting rod 126 opposing end, or small end 230, is rotatably connected to a piston 124 as previously described.

Figure 4:
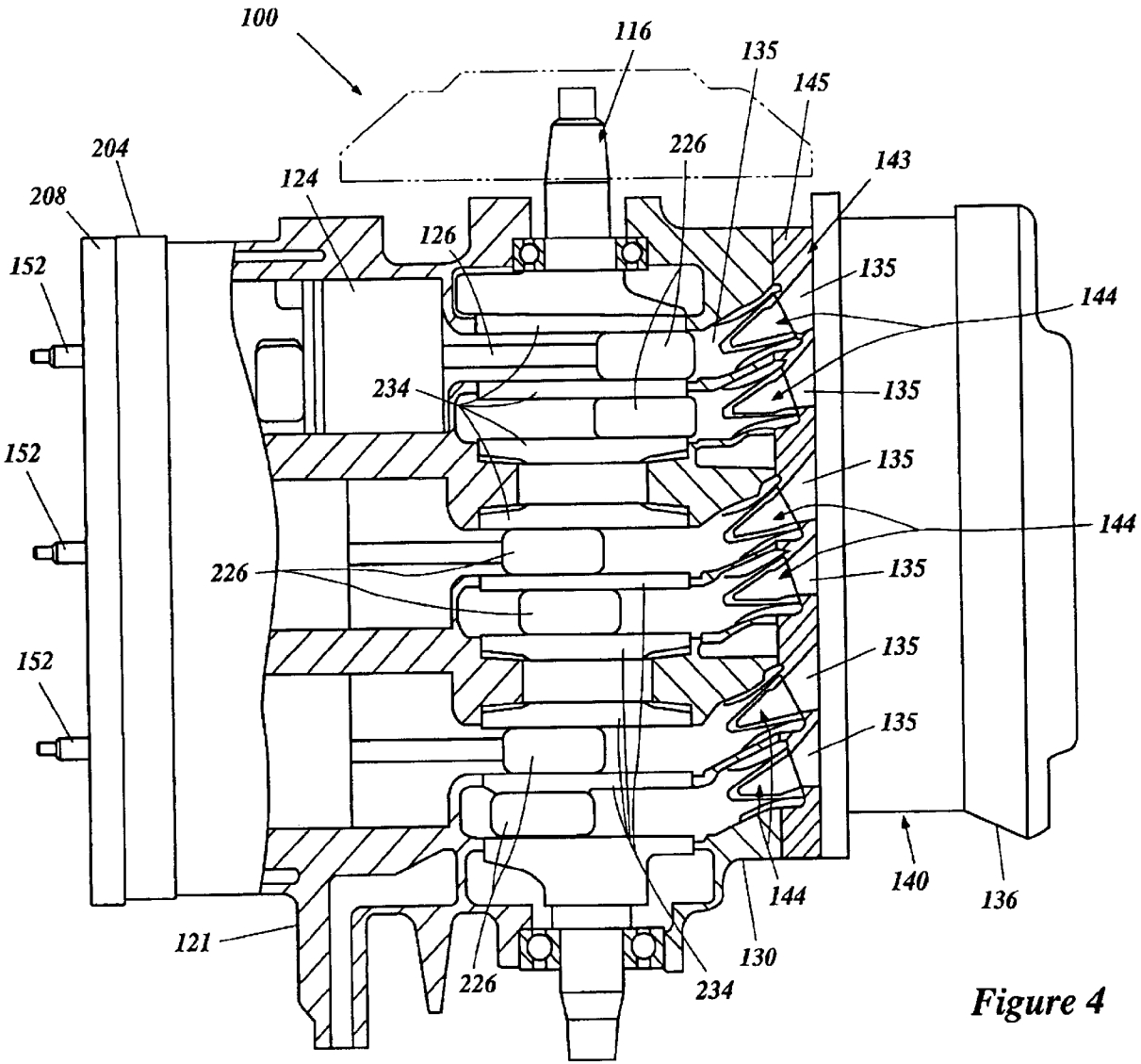
FIG. 4 is a partial sectional and side elevational view of the engine showing the crankshaft, piston rod assembly, and reed valves mounted to the crankcase of the engine.
Figure 7:
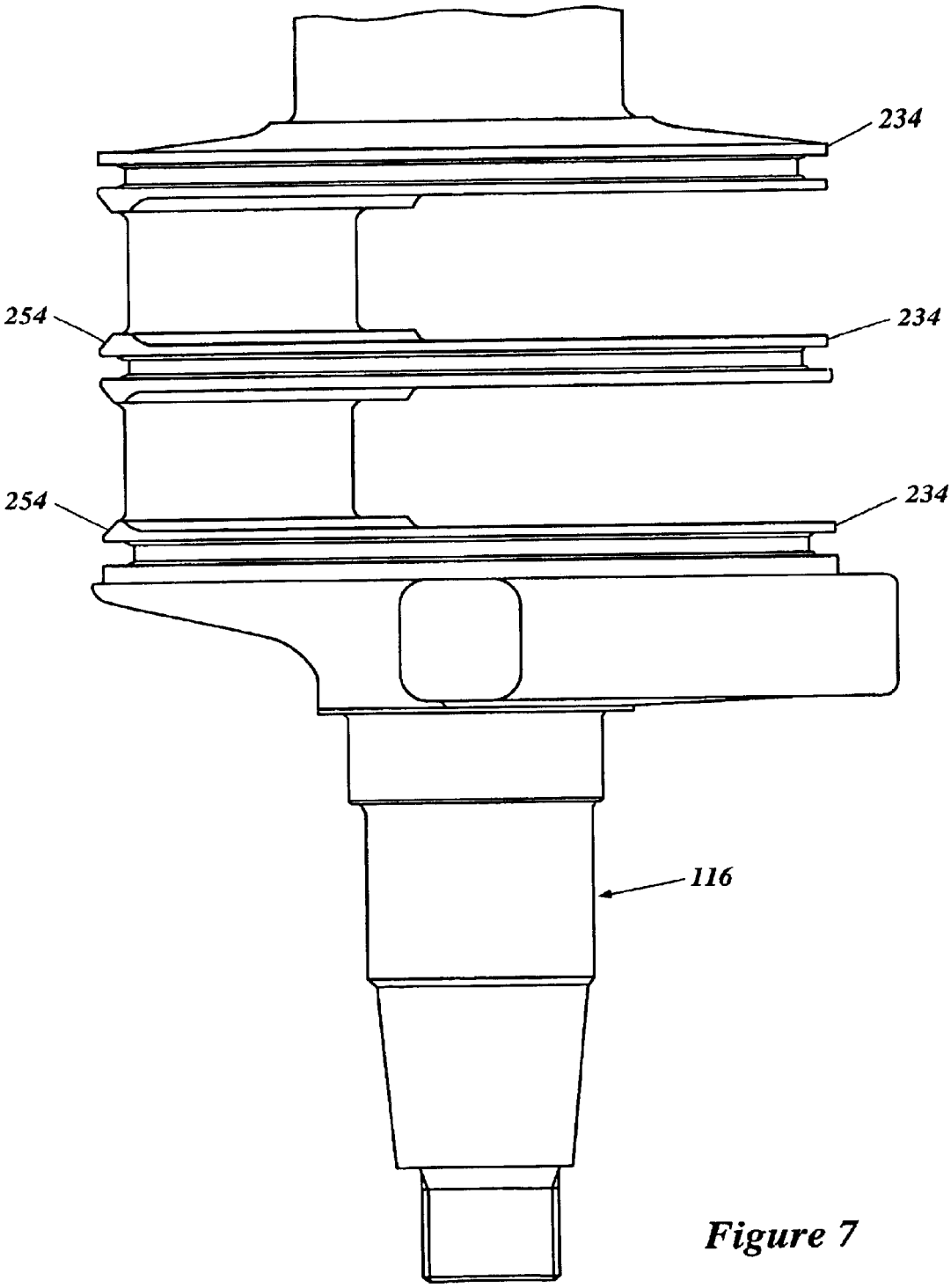
FIG. 7 is a front elevational view of a portion of the crankshaft removed from the engine.

Referring to FIGS. 4 and 7, the crankshaft 116 includes a plurality of webs 234 that cooperate with the cylinder block 121 and crankcase member 130 to separate and substantially seal each crankshaft throw 224 and associated connecting rod 126 within individual portions of the crankcase chamber 128. The air induction system delivers intake air to each of these individual portions of the crankcase chamber 128

Figure 5:
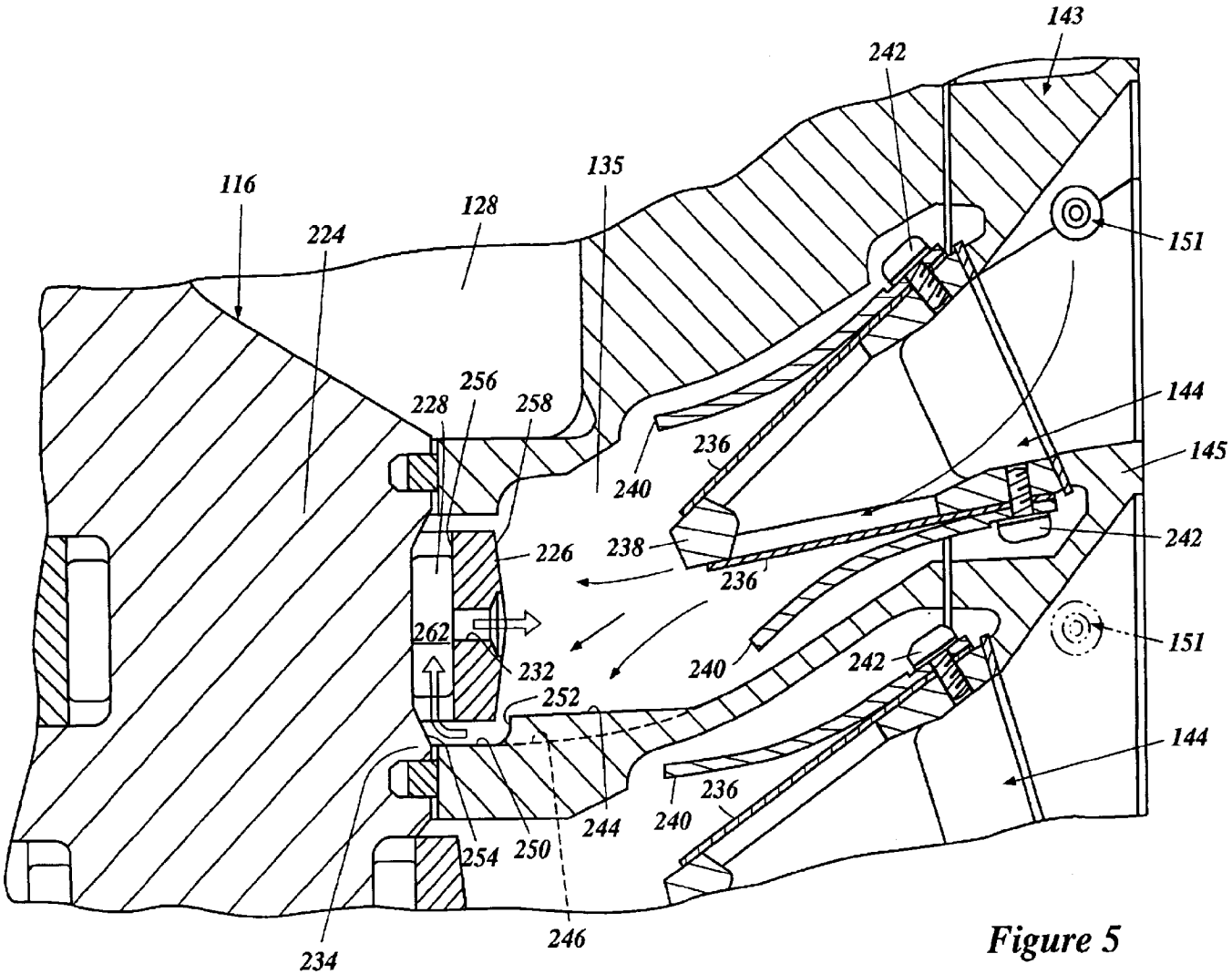
FIG. 5 is an enlarged cross-sectional view of FIG. 4 schematically showing a flow of air and oil through the reed valve and connecting rod assembly.

As shown in FIG. 5, the reed-type check valve 144 comprises a reed valve unit 143 having a reed valve holder 145 configured to carry a reed 236. The reeds 236 are biased in a closed position against a frame 238. In this orientation, the crankcase chamber 128 is closed such that air within the crankcase chamber 128 can be compressed. As the piston 124 moves away from the crankshaft 116 toward its uppermost limit (i.e., top dead center), the volume within the crankcase chamber 128 increases, thereby creating a negative pressure and drawing air into the crankcase chamber 128 from the intake passageway 125. This air pressure causes the reeds 236 to open away from the frame 238 to thereby allow air to enter the crankcase chamber 128. The reed's 236 travel limit is defined by a stopper plate 240 attached to the reed-valve holder 145 such as by mounting screws 242.

Figure 6:
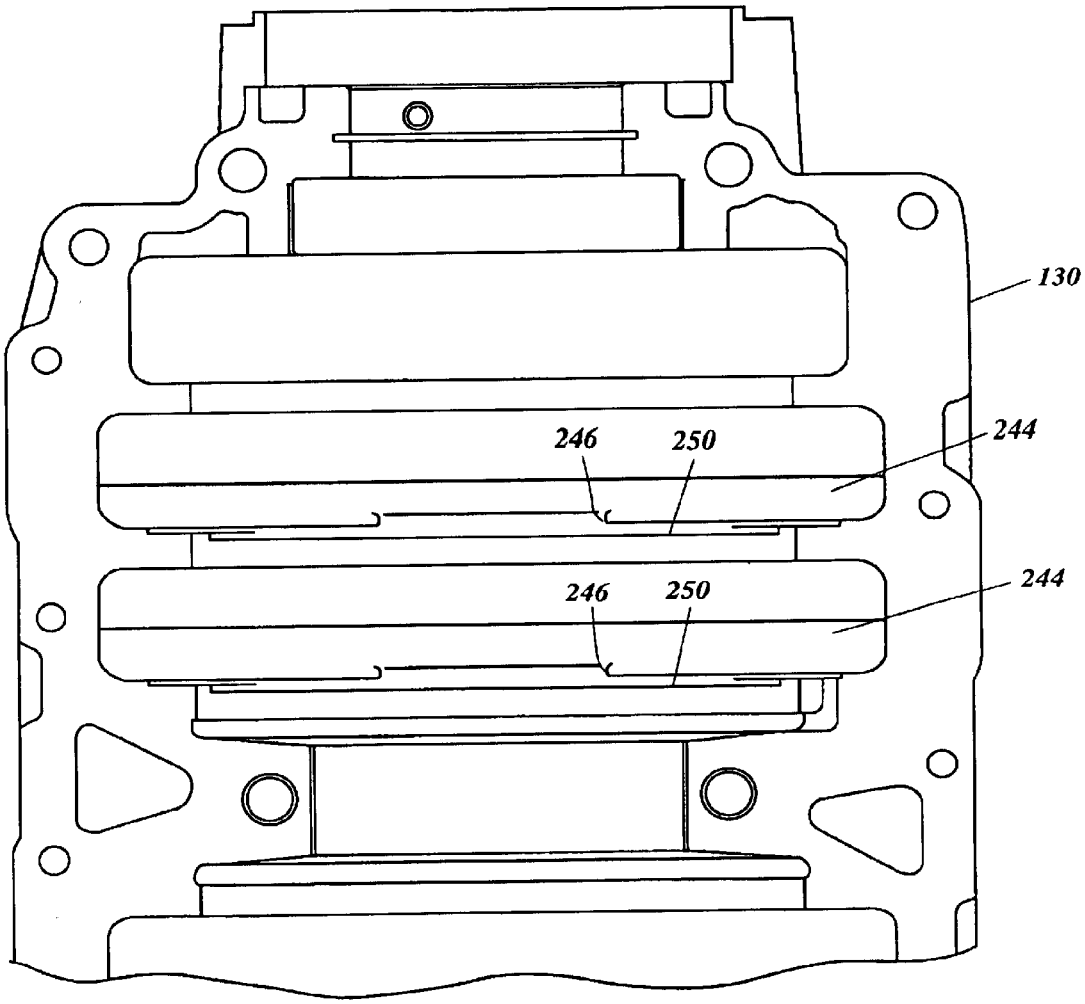
FIG. 6 is a front elevational view of the crankcase and crankshaft.

Referencing FIGS. 4–6, the crankcase bottom wall 244 preferably includes a lubricant guide groove 246 formed therein leading to a lubricant recess 250. As shown additionally in FIGS. 2 and 3, the lubricant recess 250 is semi-circular, and extends around a portion of the perimeter of the crankshaft 116. The sides of the lubricant recess 250 are defined by an outer sidewall 252 which, in one embodiment, is a substantially vertical portion of the crankcase bottom wall 244, and by an outer peripheral surface 254 of the crankshaft web 234 forming the inner boundary. In at least one embodiment, the outer peripheral surface 254 of the crankshaft web 234 has a draft angle that inclines away from the center of the lubricant recess 250, discussed below in greater detail.

The lubricant guide groove 246 extends from approximately below the inner extremity of the reed valve 144 to the lubricant recess 250 and is configured so as to urge lubricant to flow toward the crankshaft 116. During engine operation, a quantity of oil discharged by the oil delivery pipe 151 deposits on the components within the intake passageway 135. Such oil deposition occurs more quickly when the mist moves more slowly, such as when the engine is operating at lower speeds, including idling speed. The oil, under gravitational force, will tend to collect at the lower crankcase bottom wall 244.

Accordingly, the lubricant guide groove 246 is configured to direct this collecting oil to flow toward the lubricant recess 250. In one embodiment, the lubricant guide groove 246 slopes downwardly toward the lubricant recess 250 to urge the oil to flow in that direction. The oil is further urged through the lubricant guide groove 246 by the intake air. For example, as the piston 124 moves toward the combustion chamber 206, the intake air is drawn in through the intake passageway 135 and through the reed valve 144 which tends to push the deposited oil along the lubricant groove 246 toward the lubricant recess 250. Further, as the deposited oil collects in the lubricant recess 250, it is urged toward the outer peripheral surface 254 of the crankshaft web 234.

The connecting rod endcap 226, during a range of its rotational movement, is disposed above, and in close proximity to, the lubricant recess 250. As such, the connecting rod endcap 226 contacts the collected oil in the lubricant recess 250. As the crankshaft 116 rotates, a centrifugal force causes the oil deposited on the connecting rod endcap 226 to be thrown around the interior of the crankcase chamber 128.

Figure 8A:
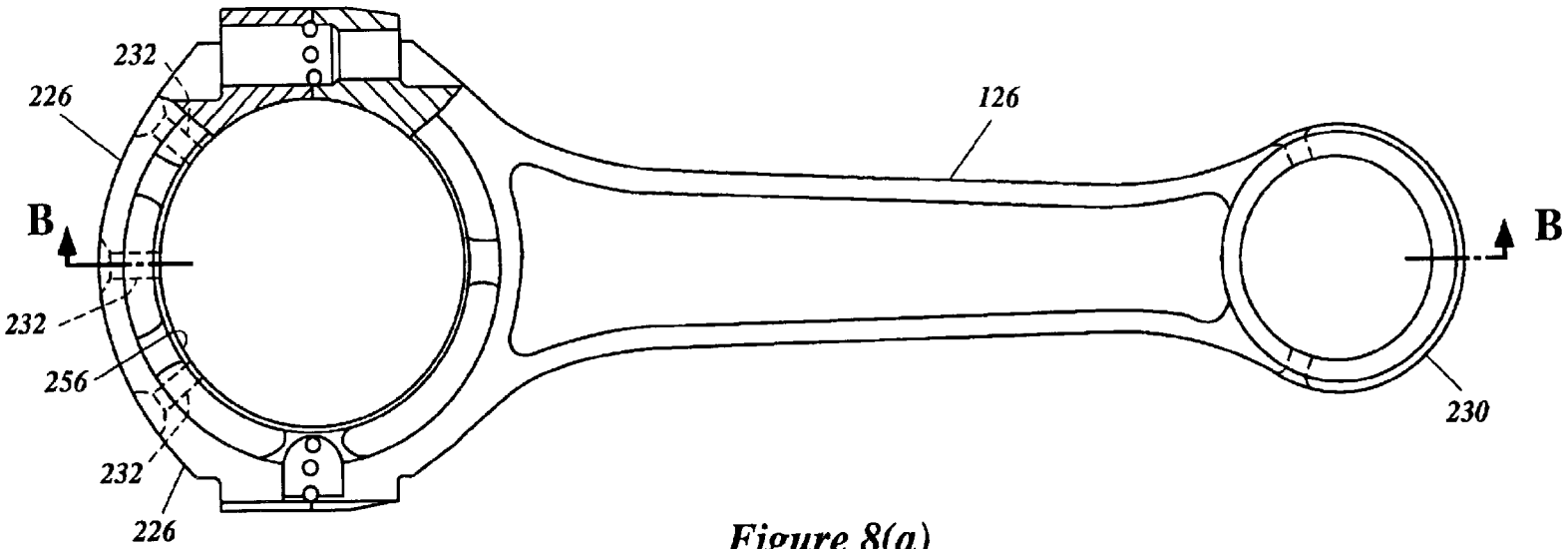
FIG. 8A is a top plan view of a connecting rod removed from the engine.
Figure 8B:
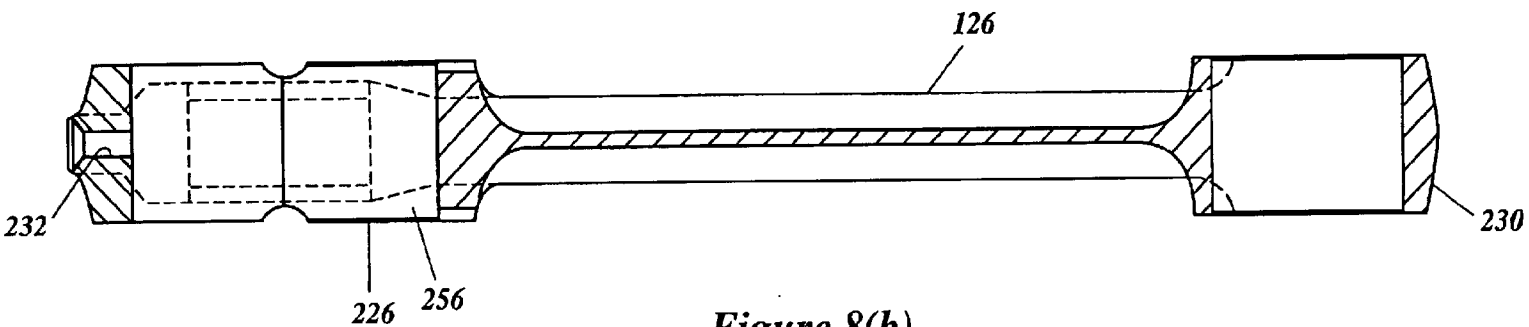
FIG. 8B is a cross-sectional view taking along line B—B of FIG. 8A.

Referencing FIGS. 5 and 8, the connecting rod 126 has a small end 230 configured for rotatable attachment to a piston 124. The opposing end includes an endcap 226 formed with one or more oil holes 232 therethrough. The oil holes extend from an inner peripheral surface 256 to an outer peripheral surface 258 of the endcap 226 and permit fluid communication therebetween. In at least one embodiment, the inner peripheral surface 256 of the endcap 226 is directly above the lubricant recess 250 during a range as the crankshaft rotates. This location of the inner oil hole 232 opening facilitates oil draw upwardly into the roller bearing space 262.

Thus, as the crankshaft 116 rotates, oil that is deposited onto the inner peripheral surface 256 of the endcap 226 flows upwardly into the roller bearing space 262 and is exits the oil hole 232 as shown by the arrows of FIG. 5. The rotation of the crankshaft 116 causes air turbulence above the lubricant recess 250 and causes the oil deposited within the lubricant recess to flow within the lubricant recess 250 in a direction corresponding to the direction of rotation of the crankshaft.

For example, if the crankshaft 116 rotates in a clockwise direction, the oil within the lubricant recess 250 will tend to flow within the lubricant recess 250 in a clockwise direction and will thus collect toward a clockwise end 260 (FIG. 3) of the lubricant recess 250. Accordingly, there may be a greater volume of oil collecting in this portion of the lubricant recess 250. As the endcap 226 approaches the clockwise end 260 of the lubricant recess 250, the available volume for the oil to occupy will be reduced and will thus cause the oil to flow rather than be subjected to compressive forces. The oil will therefore be forced to flow in a counter-clockwise direction within the lubricant recess 250, or upwardly into the roller bearing space 262 between the endcap 226 and the crankshaft throw 224. Typically, oil will flow both upwardly into the roller bearing space 262 and within the lubricant recess 250. The outer peripheral surface 254 of the crankshaft throw 224 further aids the upward flowing of oil into the roller bearing space 262.

As the oil flows into the roller bearing space 262, it not only provides a direct lubrication to the roller bearings 228 contained therein, but is also thrown outwardly through the oil holes 232 as the crankshaft 116 rotates and becomes deposited onto the various components within the crankcase chamber 128, thus providing additional lubrication to the engine components, even during periods of relatively slow operation. Moreover, oil is free to enter the roller bearing space 262 from above the endcap 256 and flow downward to provide further lubrication to roller bearings 228 and be thrown through the oil holes 232.

In addition to the contact of the endcap 256 directly with the oil in the lubricant recess 250 that causes the oil to flow into the roller bearing space 262, air pressure also urges the oil to flow upwardly into the roller bearing space 262. As the crankshaft 116 rotates, even at a slow rpm, such as, for example, 1000 rpm, a pressure differential is created between the inner peripheral surface 256 and the outer peripheral surface 258 of the endcap since a point on the outer peripheral surface 258 is traveling at a greater tangential velocity than a corresponding point on the inner peripheral surface 256. Thus, according to Bernoulli's principal, the air pressure differential will cause air and oil to flow from the region of relatively higher pressure at the interior peripheral surface 256 of the endcap 226 to the region of lower pressure at the outer peripheral surface 258 of the endcap 226.

This air pressure differential can also cause air to circulate from within the roller bearing space 262 outwardly through the oil holes 232. Consequently, the moving air will draw oil from the lubricant recess 250 up into the bearing space 262 which will then be thrown out the oil holes 232. The drawing of liquid oil from the lubricant recess 250 is further enhanced by the draft angle of the outer peripheral surface 254 of the crankshaft web 234. As an air flow path is established by the pressure differential, the rushing air will cause oil within the lubricant recess 250 to flow up the incline of the outer peripheral surface 254 and into the roller bearing space 262 where it will flow through the oil holes 232 and be thrown about the crankcase chamber 128.

Once the oil is thrown throughout the crankcase chamber 128, it may again collect at the crankcase bottom wall 244 through gravity and be recirculated throughout the crankcase chamber 128 as described herein. Additionally, especially during periods of slower operation when there may be insufficient oil entrained in the intake air, oil thrown around the crankcase chamber 128 may become entrained in the intake air and thus provide increased lubrication to the combustion chamber 206 and related components.

Thus, an improved lubrication system includes a crankcase 130 which may have a lubricant guide groove 246 and/or a lubricant recess 250 formed therein. A connecting rod 126 may include oil holes 232 formed through the connecting rod endcap 226. At least one embodiment of the improved lubrication system is configured to redistribute oil collecting within the intake passageway 135 and crankcase chamber 128 to the roller bearings 228 and other various components disposed within the crankcase chamber 128.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A lubrication system for a two-cycle engine comprising a vertical crankshaft and a lubrication recess disposed generally adjacent to a throw of said crankshaft which opens upwardly such that at least a portion of an endcap of a connecting rod connected to said throw of said crankshaft passes over said recess.

2. The lubrication system of claim 1, wherein said lubrication recess is formed in an interior wall of a crankcase of said two-cycle engine.

3. The lubrication system of claim 2, further comprising a guide groove extending generally from an air intake of said crankcase to said lubrication recess formed in said interior wall of said crankcase.

4. The lubrication system of claim 1, wherein said endcap includes a hole formed therethrough thereby providing an opening in an interior surface of said endcap and an opening in an exterior surface of said endcap.

5. The lubrication system of claim 4, wherein said opening in said interior surface of said endcap passes over said lubrication recess during a predetermined range of crankshaft rotation.

6. The lubrication system of claim 1, wherein said two-cycle engine is a direct fuel injection engine.

7. A two-stroke internal combustion engine comprising one or more cylinders wherein each cylinder has a piston for reciprocation therein, a connecting rod rotatably coupled to each piston and further including an endcap to facilitate coupling of the connecting rod to a throw of a crankshaft, wherein the crankshaft is disposed generally vertically, a lubrication recess disposed adjacent to the crankshaft and generally below a throw of the crankshaft, one or more oil holes formed through the endcap thereby providing fluid communication between an opening in an interior peripheral surface and an opening in an exterior peripheral surface of the endcap, wherein rotation of the crankshaft causes each opening in the interior peripheral surface of the endcap to pass over the lubrication recess.

8. The two-stroke internal combustion engine of claim 7, wherein the rotation of the crankshaft causes a pressure differential between the interior surface of the endcap and the exterior surface of the endcap such that oil from within the recess is drawn upwardly and into the interior peripheral surface opening and is thrown through the exterior peripheral surface opening.

9. An outboard motor having a powerhead, a driveshaft housing depending from the powerhead, and a lower unit connected to and disposed below the driveshaft housing, the powerhead including an internal combustion engine coupled to a propeller of the lower unit through a driveshaft extending through the driveshaft housing for propelling a watercraft, the internal combustion engine comprising a cylinder block defining a cylinder bore and a cylinder head connected to the cylinder block, the cylinder head further defining a recess in a lower surface thereof, a piston configured for reciprocation within said cylinder bore, wherein a surface of said piston cooperates with the cylinder bore and recess to define a combustion chamber, a crankshaft disposed generally vertically and coupled to the piston through a connecting rod having a large end engaging the crankshaft and a small end engaging the piston, wherein the crankshaft is configured for rotation within a crankcase chamber defined, in part, by a crankcase member, the crankcase member further defining an air intake passageway having a valve disposed therein for regulating the delivery of air and oil to the crankcase chamber, the crankcase member further defining a lubricant recess disposed generally below the large end of the connecting rod during at least a range of the crankshaft rotation and further defining a guide groove configured to urge deposited lubricant to flow toward the lubricant recess, and wherein the large end of the connecting rod draws lubricant from the lubricant recess and throws the lubricant within the crankcase chamber.

10. A two-stroke internal combustion engine comprising one or more cylinders wherein each cylinder has a piston for reciprocation therein, a connecting rod rotatably coupled to each piston and further including an endcap to facilitate coupling of the connecting rod to a throw of a crankshaft, wherein the crankshaft is disposed generally vertically within a crankcase chamber, and one or more holes formed radially through the endcap thereby providing fluid communication between a first opening disposed inwardly from an outer peripheral surface and a second opening in the outer peripheral surface of the endcap.

11. The two-stroke internal combustion engine of claim 10, further comprising a lubrication recess disposed adjacent the crankshaft and generally below a throw of the crankshaft during at least a range of its rotation.

12. The two-stroke internal combustion engine of claim 11, wherein rotation of the crankshaft causes lubricant from within the lubrication recess to be drawn into the first opening and discharged out the second opening.

13. The two-stroke internal combustion engine of claim 12, wherein lubricant drawn into the first opening lubricates the coupling between the connecting rod and the crankshaft throw.

14. The two-stroke internal combustion engine of claim 12, wherein lubrication is drawn into the first opening by a pressure differential caused by the rotation of the crankshaft.

15. The two-stroke internal combustion engine of claim 11, wherein rotation of the crankshaft causes the endcap to splash the lubricant within the lubrication recess thereby forcing lubricant into the first opening.

16. The two-stroke internal combustion engine of claim 11, further comprising a guide groove formed in a lower surface of the crankcase and extending generally from an air intake of the crankcase to the lubrication recess.

17. A two-stroke internal combustion engine comprising one or more cylinders wherein each cylinder has a piston for reciprocation therein, a connecting rod rotatably coupled to each piston and further including an endcap to facilitate coupling of the connecting rod to a throw of a crankshaft, wherein the crankshaft is disposed generally vertically within a crankcase chamber, and a lubrication recess disposed adjacent to the crankshaft and generally below a throw of the crankshaft.

18. The two-stroke internal combustion engine of claim 17, wherein liquid oil within the crankcase chamber collects in the lubrication recess.

19. The two-stroke internal combustion engine of claim 18, wherein the endcap and/or connecting rod throw oil from within the lubrication recess about the crankcase chamber.

20. An outboard motor having an internal combustion engine with a crankshaft journaled for rotation within a crankcase and coupled to a driveshaft for rotating a propeller connected to the driveshaft, the internal combustion engine comprising means for causing oil to pool adjacent a throw of the crankshaft, and means for redistributing pooled oil around the crankcase.

* * * * *